US010094118B2

(12) United States Patent
Gill

(10) Patent No.: US 10,094,118 B2
(45) Date of Patent: Oct. 9, 2018

(54) TILTABLE BRACKET FOR A RAIN GUTTER OF A BUILDING

(71) Applicant: Paul Edmund Gill, Ohauti (NZ)

(72) Inventor: Paul Edmund Gill, Ohauti (NZ)

( * ) Notice: Subject to any disclaimer, the term of this patent is extended or adjusted under 35 U.S.C. 154(b) by 0 days.

(21) Appl. No.: 15/280,629

(22) Filed: Sep. 29, 2016

(65) Prior Publication Data

US 2017/0138055 A1 May 18, 2017

(30) Foreign Application Priority Data

Nov. 17, 2015 (NZ) ..... 714269

(51) Int. Cl.
*E04D 13/072* (2006.01)
*F16M 13/02* (2006.01)

(52) U.S. Cl.
CPC ..... *E04D 13/0722* (2013.01); *E04D 13/0727* (2013.01); *F16M 13/022* (2013.01)

(58) Field of Classification Search
CPC ..... E04D 13/0722; E04D 13/0725; E04D 13/0727; E04D 13/072; E04D 13/064; E04D 13/068; E04D 13/0685; E04D 13/076; F16M 13/022
USPC ..... 248/231.81, 48.1, 48.2, 311.2, 312.1, 248/27.8, 310, 312–313, 449, 448, 316.4; 52/13–16, 11–12
See application file for complete search history.

(56) References Cited

U.S. PATENT DOCUMENTS 3,630,473 A 12/1971 Landis
4,071,976 A * 2/1978 Chernewski ..... A47G 7/044 248/312.1
4,311,292 A * 1/1982 Deason ..... E04D 13/076 248/48.2
4,561,616 A 12/1985 Robinson
5,127,133 A * 7/1992 Brucker ..... E04D 13/0722 16/373
5,335,460 A 8/1994 Smith, Jr.
7,434,699 B2 * 10/2008 Stukenberg ..... A47G 1/1646 211/41.1

* cited by examiner

*Primary Examiner* — Christopher Garft
(74) *Attorney, Agent, or Firm* — Diament Patent Law, P.C.; Adam L. Diament

(57) ABSTRACT

The invention is a tiltable bracket assembly for a rain gutter of a building, the assembly including an elongate clip configured to engage with an edge of the rain gutter; and a support bracket, wherein the support bracket includes a vertical element and a horizontal element, wherein the horizontal element including a hinged flap for a base of the rain gutter; characterized in that the vertical element of the support bracket includes a track for the elongate clip, and wherein the horizontal element of the support bracket includes a slot for the elongate clip. The elongate clip is configured to slide along the vertical element of the support bracket to engage and disengage with the upper rear edge of the rain gutter. When disengaged, the flap can be articulated to facilitate the pivotal movement of the rain gutter. This allows the gutter to be easily emptied or cleared of leaves or snow of the like as required.

12 Claims, 5 Drawing Sheets

TILTABLE BRACKET FOR A RAIN GUTTER OF A BUILDING

CROSS REFERENCE TO RELATED APPLICATIONS

This application claims the benefit of New Zealand Patent Application No. 714269, filed on Nov. 17, 2015. The subject matter of this earlier filed patent application is hereby incorporated by reference in its entirety.

TECHNICAL FIELD

The invention generally relates to a tiltable bracket for a rain gutter of a building. The purpose of the bracket is to facilitate the pivotal movement of the rain gutter with which it is to be used. This allows the gutter to be easily emptied or cleared of leaves, snow or the like as required.

BACKGROUND ART

Most domestic buildings are constructed with rain gutters about the perimeter of its roof line. During periods of rainfall, these collect water that may fall upon the roof and conduct it towards drain pipes servicing a local storm water system.

Over a period of time, rain gutters can collect debris and detritus such as fallen leaves, branches and other rubbish. These can collect in the rain gutter and create blockages which obstructs and slows movement of rain water therein. In periods of rain where the gutters collect water faster than it can be conducted towards the drainage pipes, this has the potential to cause an overflow of water towards the building.

This can cause leakages into the ceiling and wall spaces of the building and may even penetrate into the living or working space. Furthermore, if not dealt with, prolonged contact with water can rot the structures of the building particularly those that are adjacent to the rain gutter, such as the fascia or soffit.

Conventional methods of cleaning rain gutters of debris requires people to ascend ladders in order to reach the rain gutter. The debris can then be cleared by scooping it out with hands or tools such as a trowel or the like. However, this can place people at risk of a fall from some height should they lose their balance while cleaning the rain gutters. This can be particularly concerning for the elderly.

To help minimise the need for people to ascend ladders in order to clear rain gutters, devices to tilt rain gutters from the ground have been developed. For example, one such device is disclosed in U.S. Pat. No. 5,335,460. This describes the use of a hinged hanger which is secured to the fascia and the bottom of the rain gutter respectively. By articulating a rope pulley system, the rain gutter can be pivoted or otherwise tilted upside down. This allows the debris contained within the gutter to fall to the ground where it can be easily removed.

The disadvantage of this arrangement is the loading that is placed upon the pulley when it is full of debris. It can be quite heavy to pivot the gutter when it is full of debris and this can place strain on the ropes of the pulley system. These ropes can deteriorate over time and there is the possibility of their failure under a large load.

Furthermore, there are constraints to the placement of the pulleys which must be at or proximate the ends of the gutter. The building may have structures from the soffit or downpipes that limit or obstruct the pulleys.

Additionally, the gutter itself is only secured by its underside. This also places considerable loading on the fasteners and portion of the bracket which is mounted to the soffit of the building.

It is an object of the present invention to address the foregoing problems or at least to provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of example only.

SUMMARY

According to one aspect of the present invention there is provided a tiltable bracket assembly for a rain gutter of a building, the tiltable bracket assembly including:

an elongate clip configured to engage with an edge of the rain gutter; and a support bracket, wherein the support bracket includes a vertical element and a horizontal element, wherein the horizontal element including a hinged flap for a base of the rain gutter;

characterised in that the vertical element of the support bracket includes a track for the elongate clip, and wherein the horizontal element of the support bracket includes a slot for the elongate clip.

According to another aspect of the present invention there is provided a kit set for installing a tiltable bracket assembly for a rain gutter to a building, the kitset including:

a tilitable bracket assembly, including an elongate clip configured to engage with an edge of the rain gutter and a support bracket, wherein the support bracket includes a vertical element and a horrizontal element, wherein the horizontal element including a hinged flap for a base of the rain gutter, wherein the vertical element of the support bracket includes a track for the elongate clip, and wherein the horizontal element of the support bracket includes a slot for the elongate clip; a plurality of fasteners to secure the support to a fascia of the building with which the tiltable bracket assembly is to be used.

According to another aspect of the present invention there is provided a kit set for installing a tiltable bracket assembly for a rain gutter to a building, wherein the kitset is substantially as described above and also includes:

an elongate tool configured to engage with the elongate clip.

The invention provides a means of securing a rain gutter by its bottom surface as well as an upper surface without compromising the ability for the rain gutter to be pivoted about a horizontal axis. This is achieved through the use of a two-part tiltable bracket, in which an elongate clip that secures the rain gutter about an upper edge is slidably movable relative to a support bracket on which the bottom of the rain gutter is mounted. A tool may also be provided in order to articulate the clip.

The invention is a tiltable bracket assembly for use with a rain gutter. For ease of reference, throughout the remainder of this specification, the tiltable bracket assembly shall be referred to simply as a tiltable bracket.

It will be understood that a rain gutter is basically an open channel, with a base and opposing walls. They are typically formed from lengths of PVC which are connected to each other with clips or expansion joints. However, this is not meant to be limiting and some gutters can be formed from aluminium or copper or other metals or plastics material.

Rain gutters are provided to the market in a variety of profiles and as shall be apparent from the ensuing discussion, the present invention is specifically configured to be as adaptable as possible to various rain gutter profiles.

Rain gutters are typically secured through the use of conventional one-piece brackets screwed, nailed or otherwise fixed to the fascia of the building. The present invention replaces these conventional brackets.

The tiltable bracket should be understood to be of two main parts, a support bracket and an elongate clip. The elongate clip, which engages with an edge of the rain gutter, is configured to slideably engage with the support bracket.

Preferably, the support bracket and elongate clip are manufactured from sheet metal blanks that have been formed into the desired shape and profile using conventional metal stamping techniques. Alternatively, in some embodiments, the support bracket and elongate clip may be formed from metal extrusions.

The metal may be aluminium, steel or another metal that will be recognised by a person skilled in the art as being appropriate for the manufacturing technique employed while having the necessary structural integrity for the desired use.

However, in some embodiments of the invention, one or both of the main parts of the tiltable bracket may be formed from plastics material using conventional moulding techniques. A suitable and durable plastics material for this purpose will be readily identified by a person skilled in the art. For example, the plastics material may be PVC or the like.

We now discuss the support bracket and elongate clip of the present invention separately.

The support bracket is a substantially L-shaped member, having a body comprising of a vertical portion and a horizontal portion. It will be appreciated that each of the vertical and horizontal portions have a "free" end while the other ends are connected at a common juncture.

The lengths of the respective vertical and horizontal portions may vary according to the requirements of the use, but are likely to depend on minimising the amount of material used in forming the bracket (in order to reduce manufacturing costs) as well as the fascias and rain gutters of the building with which the invention is to be used. The support bracket may be provided in a range of sizes in order to provide the user with a range of choices.

In preferred embodiments, the support bracket has is formed from a length of metal that has been folded to assume the L-shaped profile, the juncture being the fold. This fold may be impressed with slightly elongate recesses to help add some strength which may be useful in minimising the risk of the horizontal portion of the support bracket moving relative to the vertical portion when under load.

In preferred embodiments of the invention, the vertical portion of the support bracket is provided with apertures by which the support bracket may be mounted to a surface of the building with which the invention is to be used. Typically, this surface will be the fascia or soffit of the building. The support bracket will be secured in place on fascia through the use of fasteners such as screws or the like.

However, in some embodiments, it is possible that it will be the horizontal portion of the support bracket that is in contact with the building and thus this portion is provided with the apertures for fasteners.

In yet another embodiment, rather than a series of apertures along the vertical portion (or horizontal portion as the case may be), an elongate slot may be provided. It will be appreciated that the slot is dimensioned to approximate the diameter of the fasteners that will be used to secure the support bracket to the building. Having a slot may give the user greater flexibility as to the positioning of the support bracket relative to the building.

The vertical portion includes a track that, in use, is configured to engage with the elongate clip such that the latter is able to slide or otherwise move along the track.

This may be achieved in a number of ways but in preferred embodiments of the invention, the track is formed by bending the side edges of the vertical portion of the support bracket upon themselves leaving a small gap there between. The side edges of the elongate clip engage with the gap.

However, this is not meant to be limiting and other ways to form a track to allow linear movement of the elongate clip will be readily apparent to a person skilled in the art.

The horizontal portion of the support bracket includes a slot close to the juncture with the vertical portion. The distance from the juncture to the slot may vary but preferably is only a millimeter or two. A portion of the elongate clip will pass through this slot, as shall be apparent from the discussion later in this specification.

In preferred embodiments of the present invention, the slot is not exactly or substantially parallel with the line defining the juncture between the vertical and horizontal portions of the support bracket. Instead, the slot angled along its length such that one end of the slot is closer to the juncture than the other end. This provides some frictional contact between part of the edges of the slot and the tail as it is moved. Without this resistance, the tail of the elongate clip may freely move through the slot, which can complicate installation of the invention.

The support bracket includes a hinged flap that is pivotally mounted to the free end of the horizontal portion. The rain gutter with which the invention is to be used is connected to the hinged flap.

The hinged flap has an upper surface and a lower surface. It will be understood that the bottom of the rain gutter is secured to the upper surface of the hinged flap. This may be achieved through the use of bonding agents such as adhesives or the like. Fasteners may also be used but persons skilled in the art will appreciate that this may require the use of sealing agents to prevent or minimise leakage through the base of the rain gutter.

The hinged flap should be understood to be a plate or the like with one edge pivotally mounted to the free end of the horizontal portion.

In preferred embodiments of the invention, the hinged flap is substantially flat. However, in some embodiments, the hinged flap may be contoured or otherwise bent such that it better conforms with the bottom of the rain gutter with which it is to be used.

The mounting of the hinged flap may be achieved in a number of ways that will be readily apparent to a person skilled in the art.

In preferred embodiments of the present invention in which the support bracket is formed from a blank of sheet metal, a hinge may be formed by folding over a tab extending from the free end of the horizontal portion. This forms a loop. Complementary tabs may be provided along one edge of the hinged flap which are likewise folded over to form loops. These, when combined with the loop of the horizontal portion and a pin, forms a hinge structure.

This hinged flap substantially approximates the dimensions of the horizontal member, although does not obscure or otherwise occlude the slot when the flap is resting atop the horizontal member. It will be appreciated that if it did so, this may inhibit the movement of the flap or the elongate clip.

The range of movement of the hinged flap is such that it limits the potential for the rain gutter to collect detritus or snow when it is in an inverted state. In winter months, when the rain gutter is inverted, any snow that may accumulate on its upwards facing surfaces may easily slide off.

As discussed above, the invention includes an elongate clip which engages with the support bracket.

The elongate clip is an elongate structure having a main body with first and second ends. The first end of the body is configured with a clip.

The width of the main body of the elongate clip substantially corresponds to the track of the vertical portion of the support bracket. Either side of the main body engages with the respective sides of the track.

The centre of the body of the elongate clip may include apertures or an elongate slot corresponding substantially with the position of the apertures in the vertical portion of the support bracket. It will be appreciated that these need to be larger than those of the support bracket to ensure that movement of the clip through the track is not inhibited by the head of the fasteners used to secure the support bracket to the building.

The second end of the elongate clip includes a tail extending therefrom. The tail should be understood to be narrower than the main body of the elongate clip.

In preferred embodiments of the invention, the tail is slightly offset laterally from the main body of the elongate clip by a distance corresponding with that between the juncture of the support bracket with which it is to be used and the slot in the horizontal portion of same. In these embodiments, the tail is in the same plane as the main body. When the slot through which it passes is slightly angled, this applies frictional force on the tail. This helps to keep it in position during installation and use.

Persons skilled in the art will appreciate that the same effect may be achieved by slight twisting of the tail along its length so it is not in the same plane as the body. In this case, the slot of the support bracket may be exactly or substantially parallel with the juncture between its vertical and horizontal portions. However, angling the slot is a process that is more easily controlled in the manufacture of the invention.

The tail is of a size approximating the dimensions of the slot that is present in the horizontal element of the support bracket. It will be appreciated that this means that to connect the elongate clip with the support bracket, the tail must be inserted into the slot and the side edges of the main body engaged with the track.

This tail may be configured with one or more of a recess, aperture or cut out into which a tool may be located in order to articulate the clip along the track. The elongate tool may take a number of configurations although it will be appreciated that one end is provided with a means that co-operates with the tail of the elongate clip. This means may be a hook, peg or similar protrusion.

The tail may include additional structures (such as apertures) so that paraphernalia such as lighting equipment, seasonal decorations, or plant pots may be suspended from the invention.

The elongate clip may be provided to the market in a number of different lengths to allow the use of the invention with gutters having different profiles. This may be achieved by varying the length of the main body or tails of the elongate clip. However, the extent to which the tail is offset from the main body will need to be consistent with the support bracket with which it is to be used.

To install the tiltable bracket to the fascia of the building with which the invention is to be used, the elongate clip is inserted into the track of the support bracket and orientated such that the respective apertures of these parts are in alignment. The apertures of the elongate clip are dimensioned to specifically be larger than the head of the fasteners used to secure the support bracket to the fascia.

The installer will then screw or drill the fasteners into the fascia. The head of the fasteners, being smaller than the apertures of the elongate clip simply pass through until contact is made with the support bracket (the apertures of which are dimensioned to approximate the shaft, but not the head, of the fasteners).

The apertures of the support bracket may progressively taper inwards to form a recess for the head of the fastener to fit substantially flush with the support bracket. This means that the fasteners do not inhibit the movement of the elongate clip up and down the track.

We now refer to the method of operation of the invention. Prior to clearing the rain gutter, mounted to the building using a plurality of the tiltable brackets that are the subject of the present specification, it may be necessary to disengage either end of the gutter from its neighbouring length or expansion joint. This is so that the length of guttering being cleared is able to freely pivot.

Then, the person wishing to clear the rain gutter would use a tool to articulate the tail of the elongate clip of the tiltable bracket, the upper end of which engages with the top of the rear edge of the rain gutter. By articulating the elongate clip upwards, the top edge becomes disengaged, leaving the rain gutter supported only by the hinged flap, which is resting atop the horizontal portion of the support bracket.

Once all the clips present along the length of the rain gutter have been disengaged, the tool can then be used to articulate the rain gutter itself from an upwards orientation where the channel is facing upwards to a downwards orientation, where it can be emptied of any debris and detritus contained therein.

Once cleared, the rain gutter can then be pivoted back about the axis of rotation of the hinged flap to return it to its original position. Each of the elongate clips can then be slid down the track such that it re-engages with the upper edge of the rain gutter.

This allows the rain gutter to be easily cleared of debris and detritus simply by using a long handled tool to articulate the clip of the invention. There is no need for ropes or pulleys to articulate the rain gutter.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Figure 1:
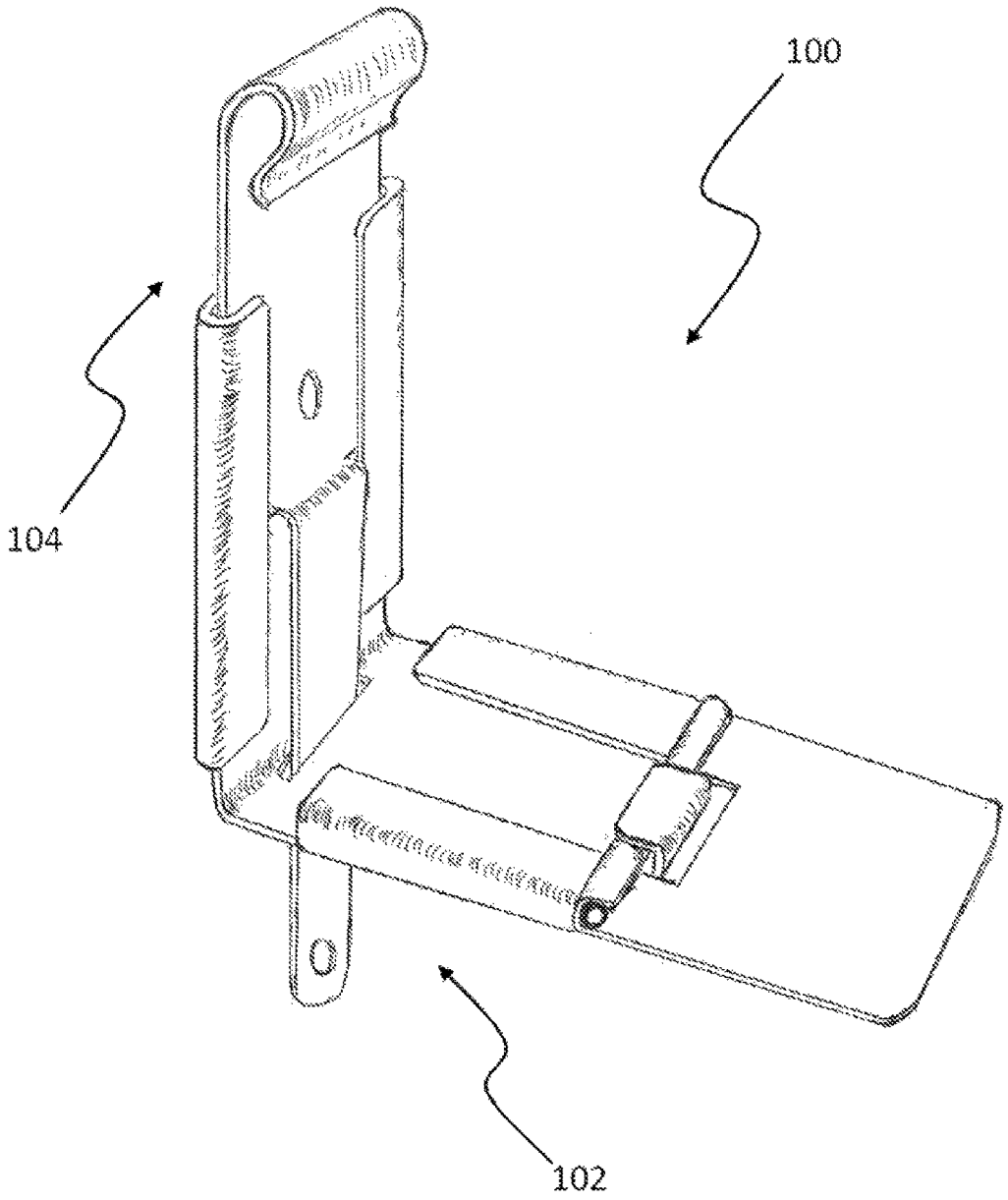
FIG. 1 is a perspective view of a two-part tiltable bracket, according to an embodiment of the present invention.

FIG. 1 shows the invention in the form of a two-part tiltable bracket (generally indicated by arrow 100). The tiltable bracket is formed of two major parts, a support bracket (102) and an elongate clip (104) which slides through the support bracket.

Figure 2:
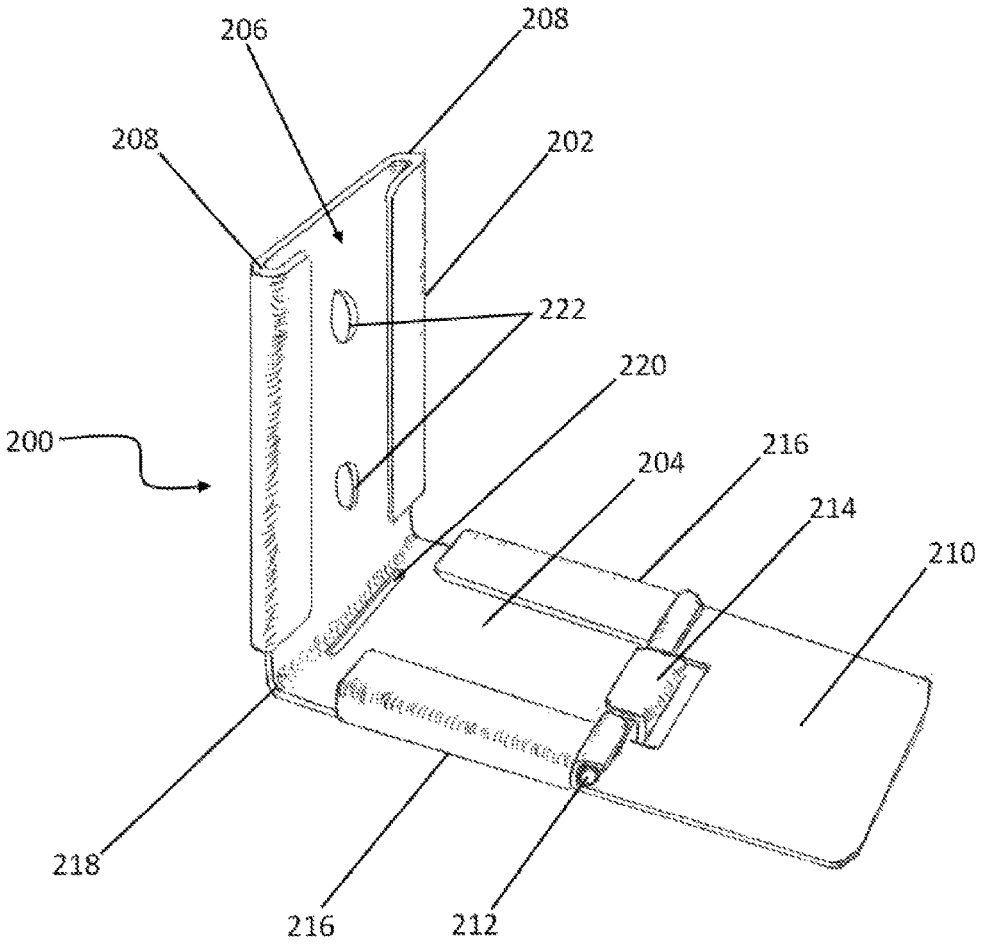
FIG. 2 is a perspective view of the support bracket of the embodiment of the invention illustrated in FIG. 1.
Figure 3:
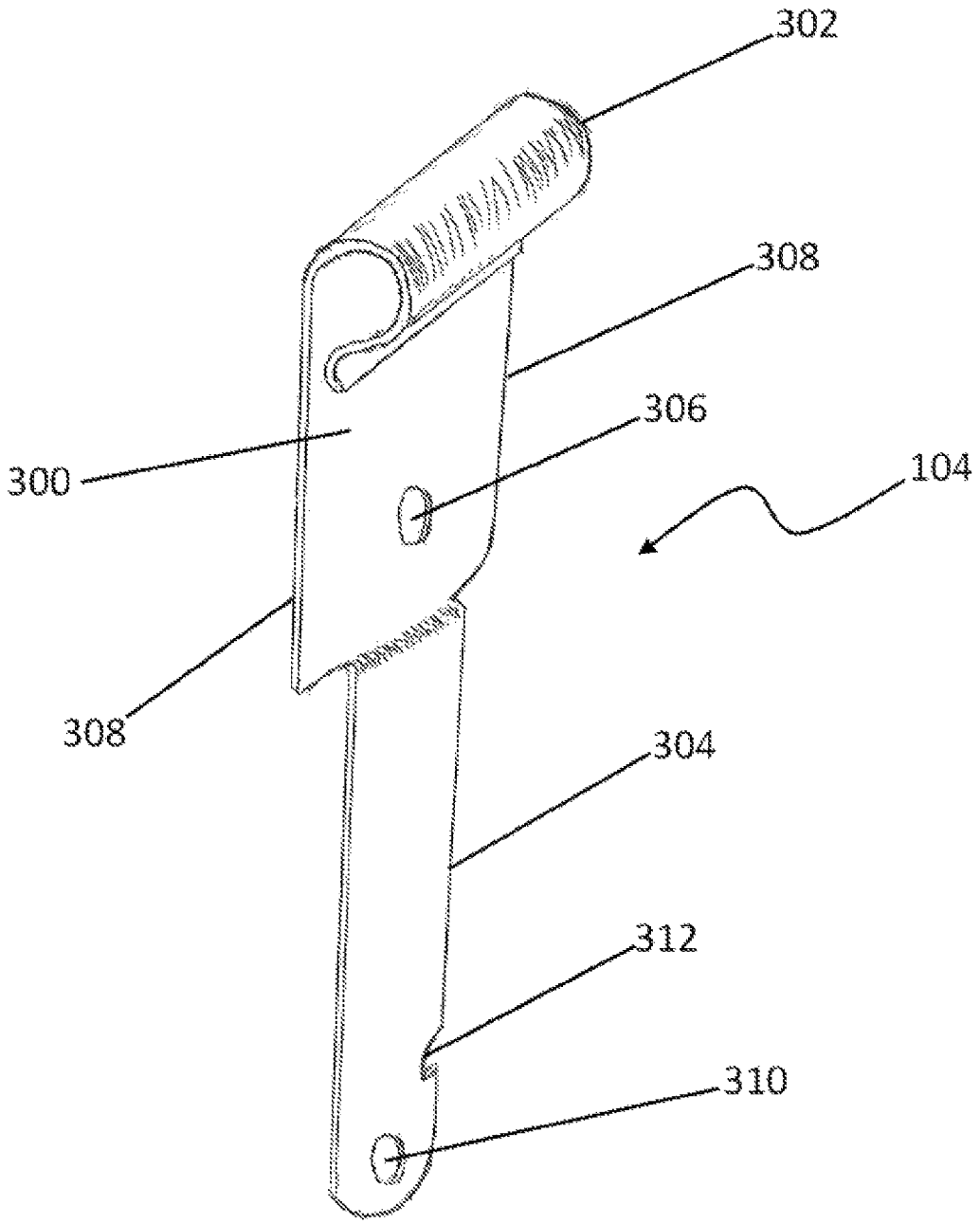
FIG. 3 is a perspective view of the elongate clip of the embodiment of the invention illustrated in FIG. 1.

The support bracket and the elongate clip are illustrated individually, for sake of clarity, in FIGS. 2 and 3 respectively.

Dealing first with the support bracket (102) of FIG. 2, this is an L-shaped structure (200), with a vertical element (202) and a horizontal element (204).

The vertical element (202) of the support bracket (102) includes a track (206) formed by folding the edges (208) of the vertical element towards each other. This defines a narrow channel at either side of the element.

The horizontal portion (204) of the support bracket (102) includes a hinged flap (210) which pivots about an axle pin (212) at the end (214) of the horizontal portion.

To help reduce the potential for distortion of the axle pin (212) when loading, from the rain gutter (not shown) is placed on it, and to provide support for the hinged flap (210) when it is in a closed state (resting on top of the horizontal portion (204), the side edges (216) of the horizontal portion have been folded over. This effectively compensates for the depth of the axle pin by increasing the thickness of the horizontal portion.

At the juncture or angle (218) formed by the vertical (202) and horizontal elements (204) of the L-shaped structure (200) is provided an elongate slot (220). This is very slightly distanced from the juncture, corresponding substantially with the distance that the tail of the elongate clip has been offset from its body (not shown). It is also angled such that one end of the slot is closer to the juncture than the other end.

In use, the vertical element (202) is affixed to the fascia of the building (not shown) with which the invention is to be used. To allow this, apertures (222) are provided through which fasteners, such as screws (not shown), pass.

Turning now to FIG. 3, the elongate clip (104) is illustrated. As can be seen, it is an elongate structure with a main body (300), the upper end of which is configured to form a clip (302). This forms a structure which in use engages with the upper rear edge of the rain gutter (not shown).

In this embodiment, the clip (302) spans the full width of the body (300); this means that once inserted into the support bracket, it cannot be pulled entirely through it.

The lower end of the main body (300) is configured with an elongate tail structure (304) extending therefrom. This is offset laterally, the extent of which substantially corresponds to the distance between the juncture and the slot of the horizontal portion of the support bracket (not shown).

Referring back to FIG. 2, it will be appreciated that the slot (220) of the support bracket (102) is dimensioned to approximate the tail rather than the main body. This is to ensure that the elongate clip cannot fall entirely through the support bracket in use. The slot is also slightly angled so that as the tail (304 in FIG. 3) moves through it, there is some friction between the contacting surfaces.

Returning to FIG. 3, it will be seen that the central portion of the elongate clip includes an aperture (306). This is dimensioned to be larger than the head of the fasteners (not shown) that would otherwise be used to secure the support bracket (not shown) to the fascia of the building (not shown) with which the invention is to be used.

Making the aperture (306) larger ensures that the heads of the fasteners (not shown) do not inhibit the movement of the clip along the vertical track of the support bracket (not shown), with which the side edges (308) of the main body (300) engage.

The tail (304) also includes an aperture (310). However, this is not intended for a fastener. A cutout (312) is also provided on the tail. These co-operate with a hook or peg of an elongate tool (not shown) wielded by the person clearing the gutters.

Figure 4A:
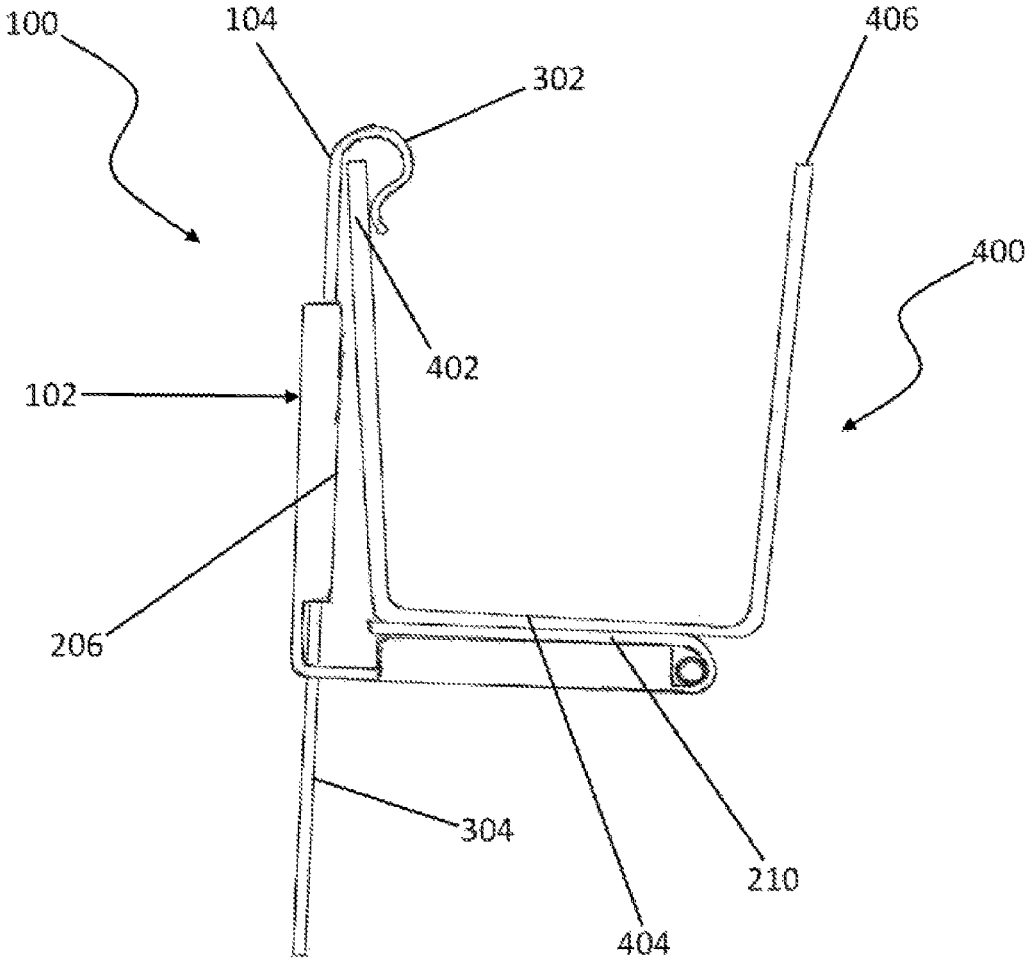
FIGS. 4*a* & 4*b* are side views of a two-part tiltable bracket in use, according to an embodiment of the present invention.
Figure 4B:
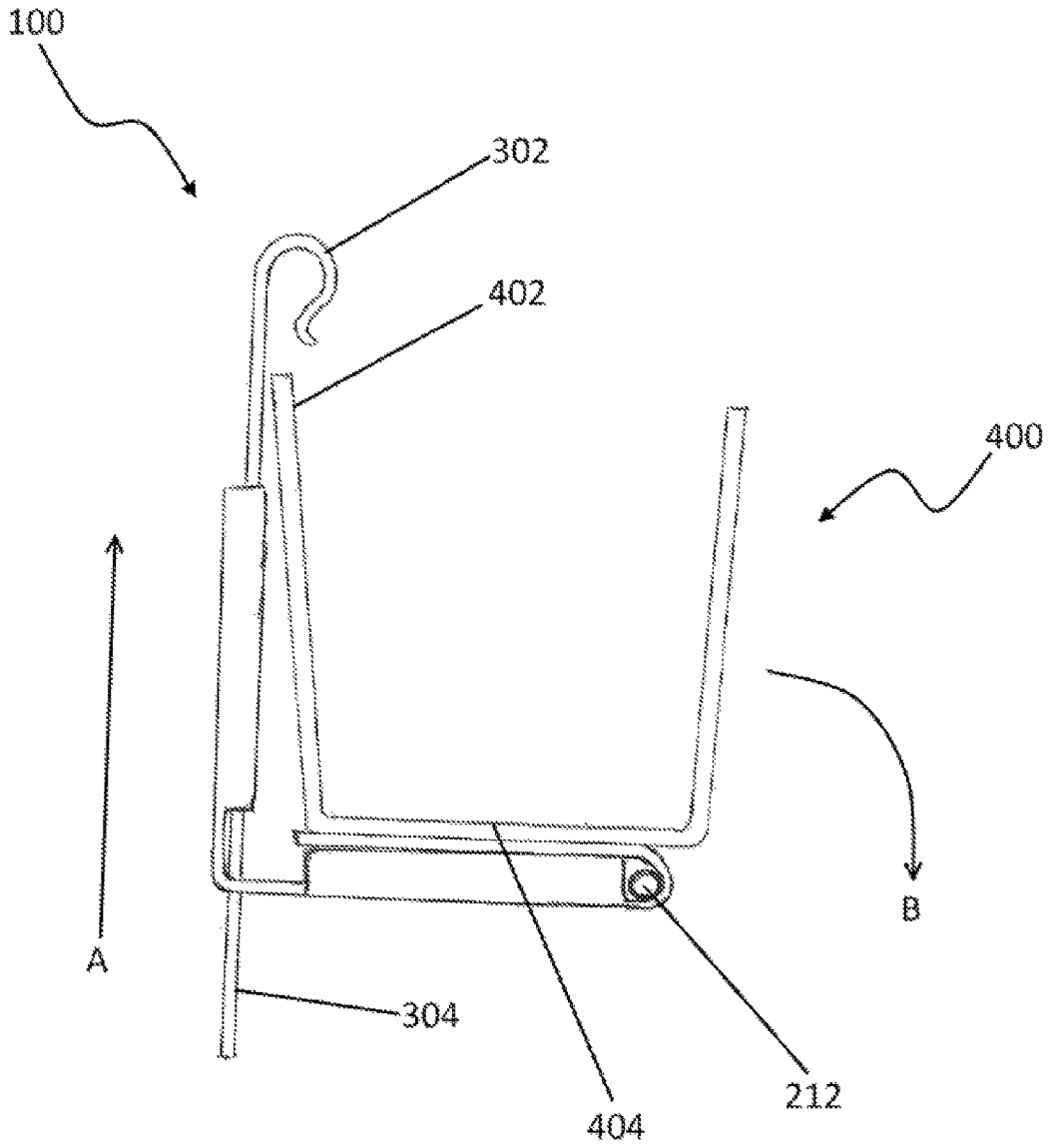

FIGS. 4*a* and 4*b* show the two main parts of the invention in use. The tiltable bracket (100) is fixed to the fascia of the building (not shown) by the support bracket (102).

The tail (304) of the elongate clip (104) is inserted into the slot (not visible in these views) of the support bracket (102) and the edges of the edges of the main body (300) aligned with the track (206).

Then, by pulling the tail downwards, the clip (302) itself moves downwards and engages with the rain gutter's (400) upper rear edge (402) as shown in FIG. 4*a*.

The base (404) of the gutter (400) is secured to the hinged flap (210). While the clip is in a secured position, both the base and the upper edge (402) of the rain gutter is held in a secured position.

However, when the clip is disengaged from the rain gutter as shown in FIG. 4*b*, by articulating it upwards along the track in the direction indicated by arrow A. This leaves the rain gutter secured only by the hinged flap, which is free to be pivoted in the direction indicated by arrow B about the axis of rotation defined by the pin (212).

Using a tool (not shown) to pull the outward facing edge (406) of the rain gutter (400) or by pressing upwards against the part of the base of the rain gutter not obscured by the tiltable bracket, it can be rotated upside down thereby allowing the accumulated debris and detritus contained therein to fall to the ground.

The same tool (not shown) may be provided with a pin to engage with the aperture (not visible) of the tail (304) of the clip portion (104). This can then be used to apply downward pressure to the elongate clip to move it relative to the support bracket (102) and force the clip (302) into engagement with the upper rear edge (402) of the gutter (400).

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

What I claim is:

1. A tiltable bracket assembly for a rain gutter of a building, the tiltable bracket assembly including: an elongate clip configured to engage with an edge of the rain gutter; and a support bracket, wherein the support bracket includes a vertical element and a horizontal element, wherein the horizontal element includes a hinged flap for a base of the rain gutter; characterized in that the vertical element of the support bracket includes a track for the elongate clip, wherein the horizontal element of the support bracket includes a slot for the elongate clip, wherein the elongate clip includes a main body having an upper end and a lower end, wherein a tail extends from the lower end of the main body, said tail being narrower than the main body, and wherein the slot is sufficiently wide to receive the tail, but is too narrow to receive the main body.

2. The tiltable bracket assembly as claimed in claim 1, wherein the slot of the support bracket is dimensioned to approximate the tail of the elongate clip.

3. The tiltable bracket assembly as claimed in claim 1, wherein the tail includes an aperture or recess.

4. The tiltable bracket assembly as claimed in claim 1, wherein the upper end of the main body includes a clip configured to engage with the edge of a rain gutter.

5. The tiltable bracket assembly as claimed in claim 1, wherein the main body of the elongate clip has side edges, wherein the side edges engage with the track.

6. The tiltable bracket assembly as claimed in claim 1, wherein the vertical element of the support bracket includes at least one aperture for a fastener.

7. The tiltable bracket assembly as claimed in claim 1, wherein the vertical element has opposing side edges, and wherein the track is formed by folding over the side edges to define a channel.

8. The tiltable bracket assembly as claimed in claim 1, wherein one end of the slot of the horizontal element of the support bracket is closer to the vertical element than the other end of the slot.

9. A kit for installing a tiltable bracket assembly for a rain gutter to a building, the kit including: an elongate clip configured to engage with an edge of the rain gutter; and a support bracket, wherein the support bracket includes a vertical element and a horizontal element, wherein the horizontal element includes a hinged flap for a base of the rain gutter, wherein the vertical element of the support bracket includes a track for the elongate clip, wherein the horizontal element of the support bracket includes a slot for the elongate clip, wherein the elongate clip includes a main body having an upper end and a lower end, wherein a tail extends from the lower end of the main body, said tail being narrower than the main body, and wherein the slot is sufficiently wide to receive the tail, but is too narrow to receive the main body.

10. The kit as claimed in claim 9, wherein the kit includes a plurality of fasteners to secure the support to a fascia of the building with which the tiltable bracket assembly is to be used.

11. A tiltable bracket assembly for a rain gutter of a building, the tiltable bracket assembly including:

a support bracket, wherein the support bracket includes a vertical element and a horizontal element, wherein the vertical element is configured to be mounted to a building, and wherein the horizontal element includes a hinged flap for a base of the rain gutter; and an elongate clip slidably engaged with the vertical element, wherein the elongate clip is configured to engage with an edge of the rain gutter;

characterized in that the vertical element of the support bracket includes a track for the elongate clip, and wherein the horizontal element of the support bracket includes a slot for the elongate clip;

wherein the elongate clip includes a main body having an upper end and a lower end, wherein a tail extends from the lower end of the main body, said tail being narrower than the main body, and wherein the slot is sufficiently wide to receive the tail, but is too narrow to receive the main body.

12. A tiltable bracket assembly for a rain gutter of a building, the tiltable bracket assembly including:

a support bracket, wherein the support bracket includes a vertical element and a horizontal element, wherein the vertical element is configured to be mounted to a building, and wherein the horizontal element includes a hinged flap for a base of the rain gutter; and an elongate clip having a main body and a tail, the tail being narrower than the main body, wherein the elongate clip is configured to engage with an edge of the rain gutter;

wherein the vertical element of the support bracket includes a track which slidably engages the main body of the elongate clip, and wherein the horizontal element of the support bracket includes a slot which slidably engages the tail of the elongate clip, said slot being too narrow to receive the main body of the elongate clip.

* * * * *